United States Patent [19]

Shiohata et al.

[11] 4,245,950

[45] Jan. 20, 1981

[54] TURBINE ROTORCONSTRUCTIONS

[75] Inventors: Koki Shiohata; Masaharu Ohno, both of Hitachi; Fumio Fujisawa, Mito; Kazuo Sato, Kitaibaraki; Sho Kusumoto; Katsukuni Hisano, both of Hitachi, all of Japan

[73] Assignee: Hitachi, Ltd., Japan

[21] Appl. No.: 879,737

[22] Filed: Feb. 21, 1978

[30] Foreign Application Priority Data

Feb. 21, 1977 [JP] Japan ..... 52/17138

[51] Int. Cl.[3] ..... F01C 3/02

[52] U.S. Cl. ..... 415/103; 416/199; 403/356

[58] Field of Search ..... 416/199, 244 A, 500; 403/273, 356, 28; 415/99, 100, 103

[56] References Cited

U.S. PATENT DOCUMENTS 3,822,953 7/1974 Adelizzi ..... 416/244 A

*Primary Examiner*—Robert E. Garrett

*Attorney, Agent, or Firm*—Craig and Antonelli

[57] ABSTRACT

Steam introduced into a turbine casing from a steam inlet is longitudinally divided and each divided steam portion flows in respective first stages which are disposed on the shaft adjacent to each other. The shaft and a plurality of disks which are manufactured independently are made integral by a thermal shrink. In order to reduce the thermal distortion effects on the shaft caused by keys interconnecting the disks and shaft, first key grooves formed on an outer surface of the shaft and an inner surface of the disks of one first stage and a first key closely disposed in the first key grooves are arranged in symmetry with respect to the center of the shaft, to second key grooves formed on an inner surface of the disk of the other first stage with a second key closely disposed in the second grooves. Other preferred embodiments include dummy grooves and keys to balance the thermal distortion effects of the keys interconnecting the disks and shaft.

1 Claim, 15 Drawing Figures

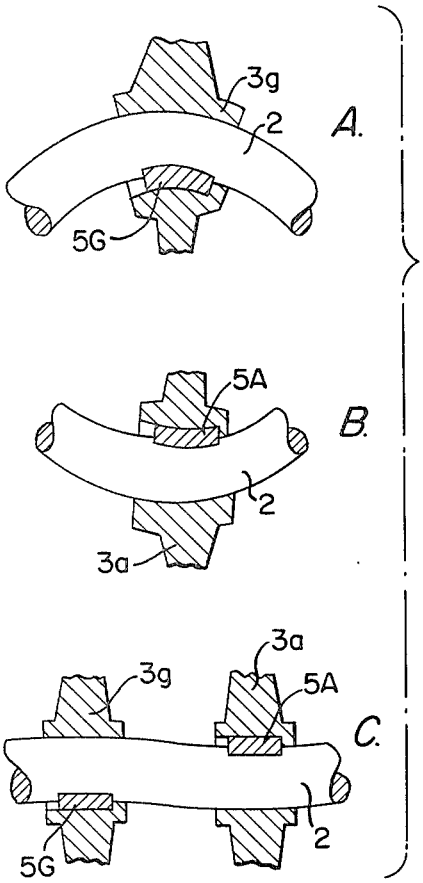
FIG. 7.
FIG. 8.
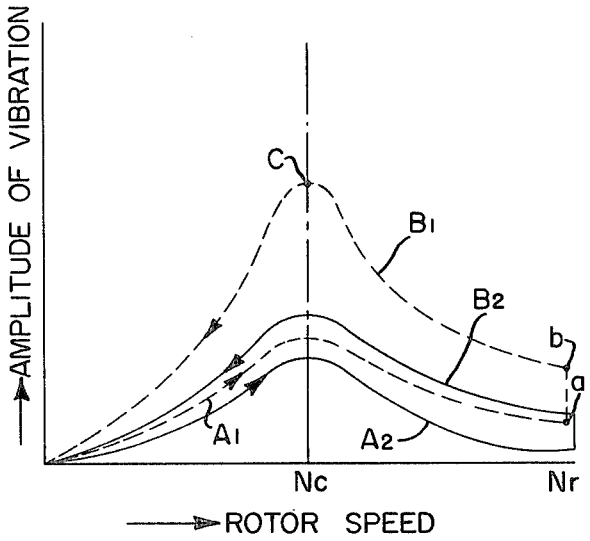
FIG. 9.
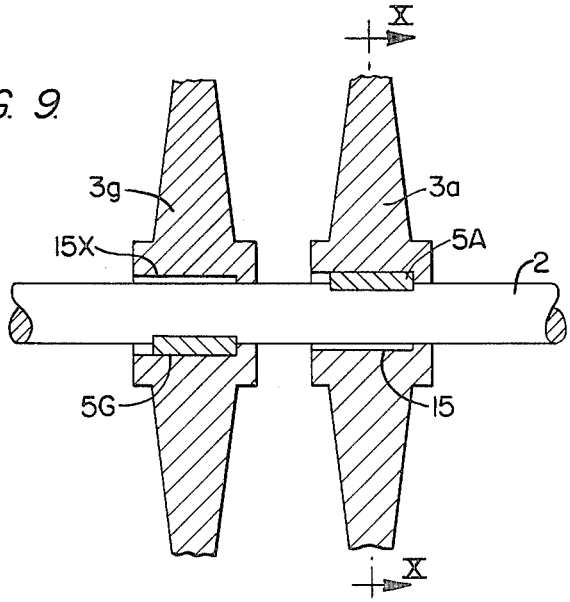

TURBINE ROTORCONSTRUCTIONS

BACKGROUND AND SUMMARY OF THE INVENTION

The present invention relates to a rotor, especially a rotor for a steam turbine with disks thermally shrink-fitted on the rotor shaft and with fixing keys between each disk and the shaft.

In prior art arrangements, a rotor of a steam turbine has been made by an integral formation of disks and a shaft. With a large size of steam turbine corresponding to a high capacity thereof, an integral manufacture is difficult because of the practical production problems, so that rotors for high capacity turbines are, as a practical matter required to be manufactured with individual rotor disks thermally shrink-fitted on a rotor shaft. Thermal shrinking of rotor disks onto a rotor shaft is made with a sufficient shrink tolerance between the disks and the shaft so as to avoid slippage between the contacting surfaces thereof and to transfer a sufficient torque.

As a further aid in avoiding slippage between the rotor disks and rotor shaft, it has been contemplated to dispose keys between the disks and rotor shaft.

An object of the invention is to reduce the thermal deflection of a rotor shaft with a key for a double flow type of steam turbine.

Another object of the invention is to provide a rotor for a double flow type of steam turbine in which a thermal deflection of a rotor shaft is made small in the area where the first stages are arranged on a shaft adjacent to each other.

Another object of the invention is to provide a thermally shrink-fitted rotor for a steam turbine, employing a new key arrangement to make thermal deflection of a rotor shaft small.

Another object of the invention is to offset thermal distortion on a rotor shaft caused by the key.

In a low pressure turbine a phenomenon in which the vibration of a rotor was excessive at a critical speed had occurred as a phenomenon particular to a thermally shrink-fitted rotor when a turbine speed was gradually decreased from the rated speed upon a load disconnection. Further, the vibration also increased when a load was connected in the rated speed. The cause of the phenomenon was investigated, and it was discovered by the inventors that the vibration had occurred due to a thermal deflection of the shaft. The thermal deflection particular to the thermally shrink-fitted rotor was caused by an unbalanced heat conductivity particular to the shaft flowing from a disk to the shaft. Especially in a double flow type of steam turbine the imbalance of the heat conductivity was large in the first stages in the region of the highest temperature in the stages. The heat transferred to blades from a steam turbine is conducted to the shaft through the disk. In the thermally shrink-fitted rotor there is provided a key groove and a key closely disposed in the groove between the disk and the shaft. This key arrangement makes the heat conductivity decrease around the key. The decreasing of the heat conductivity on a part of the shaft causes the thermal deflection on the shaft due to the temperature difference to the other portion. This was ascertained by experiments and a calculation with respect to the thermal deflection by using a computer. The inventors discovered the reason for the thermal deflection of a rotor shaft was distortion of the temperature distribution of the shaft caused by key means and provided thermal balancing means for counteracting such thermal distortions of the shaft.

BRIEF DESCRIPTION OF THE DRAWINGS

FIG. 1 is a schematic sectional view showing a thermally shrink-fitted rotor of the type the present invention is related to;

FIGS. 7(A), (B) and (C) are views showing a thermal deflection of a rotor shown in FIGS. 4 and 5;

FIG. 8 is a view comparing the amplitude of the vibration of a rotor provided by the invention and a prior rotor;

FIG. 9 is a view showing another embodiment of a rotor provided by the invention;

DETAILED DESCRIPTION OF THE DRAWINGS

Figure 1:
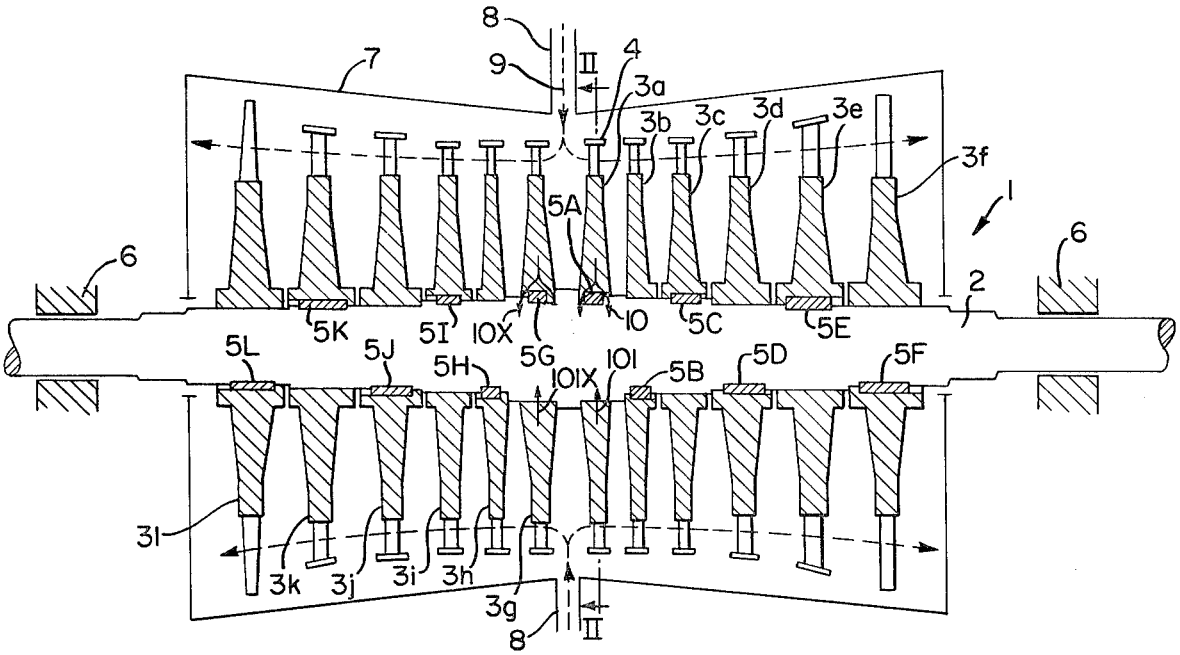
Figure 2:
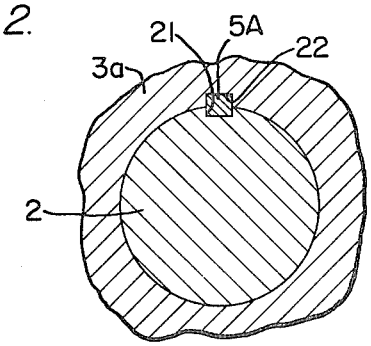
FIG. 2 is a sectional view along line II—II of FIG. 1.
Figure 3:
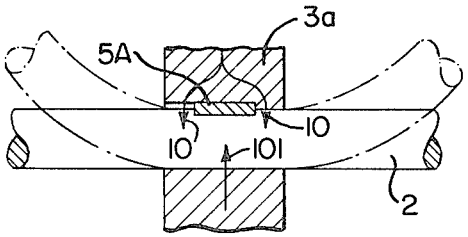
FIG. 3 is a view showing a thermally shrink-fitted rotor with a thermal deflection.

FIG. 1 is a longitudinal sectional view illustrating a thermally shrink-fitted rotor of a double flow type of a steam turbine. A rotor is made from a rotor shaft 2 supported by bearings 6, rotor disks 3*a*~31, thermally shrink-fitted on the rotor shaft 2, holding keys 5 between the rotor disks and the rotor shaft as shown in FIG. 2 in detail, and turbine blades equipped on the peripheral surfaces of the rotor disks 3*a*~31. The numeral 7 shows a turbine casing. Around the longitudinally central portion of the casing 7, a plurality of steam inlets 8 is installed. Steam of nearly 350° C., like steam to a low pressure turbine of a power plant, flows into the casing 7 from the steam inlets 8 as shown by a dotted line 9. After that the steam is diverged or divided to form the double flow and works in each stage of the turbine with a resultant decrease of temperature and pressure and finally flows out from the last stage.

In the above described turbine, the operational temperature distribution of the rotor 1, due to the steam flow path, is such that the temperature of the rotor shaft 2 is low but that of the rotor disks 3*a*~31 is high. Heat currents 10, 10X, 101, 101X are therefore generated from the outside of the larger diameter disks 3*a*~31 to the center portion of the smaller diameter rotor. The resistance against the heat current is larger on portions of the shaft equipped with the keys 5A and 5G than the resistance on the diametrically opposite portions of the shaft. Namely, the heat currents 101 and 101X are larger than the heat currents 10 and 10X. Especially, there occurs a large heat current resistance difference in the area of a space formed around the keys 5. Due to the resistance difference the portion of the shaft equipped with the keys 5 is lower in temperature than the diametrically opposite portion. This causes a bending deflection of the shaft 2. The temperature difference is quite significant in the neighborhood of the steam inlets (due to the very high temperature incoming steam flow), namely around the longitudinally central portion of the shaft, so that the bending deflection reaches its maximum on the portions equipped with the keys in the area of the steam inlets.

In spite of this phenomenon, in prior arrangements, owing to the fact that the keys 5A and 5G equipped on the first stage disks 3*a* and 3*g* disposed on the same side as shown in FIG. 1, the bending deflection towards the same direction has occurred on the portions contacting with the disks 3*a* and 3*g* on the shaft. This bending deflection at adjacent disks 3*a* and 3*g* creates an unbalancing effect causing vibration of the rotor during operations of the turbine. With increase of the bending deflection, the vibration of the rotor increases. This unbalancing effect was especially great for vibration at the first resonant frequency of the rotor shaft, so that there was a difficulty in passing of a first critical rotational speed corresponding to said first resonant frequency. It was difficult to remove the unbalance element which appeared due to the thermal bending by way of a previous balance treatment.

In the event that the vibration appears much larger in excess of a permitted extent, a rotor is made to fail. Accordingly, the removing of the thermal bending deflection is very important for keeping reliability of a rotor.

Figure 4:
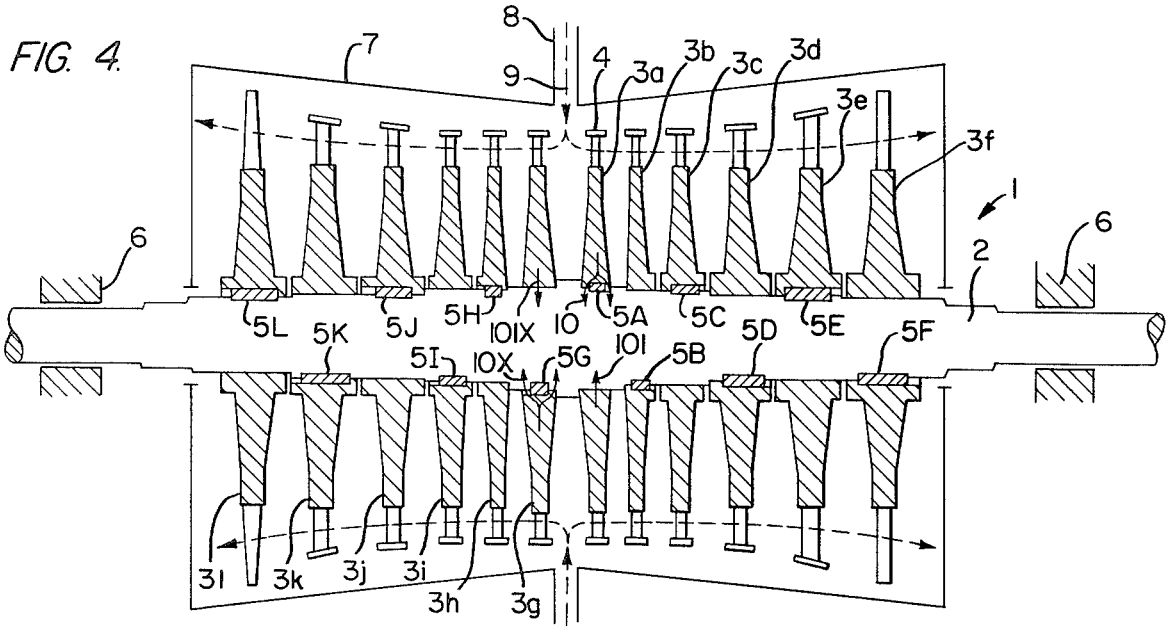
FIG. 4 is a sectional view showing an embodiment of a thermally shrink-fitted rotor, provided by the invention.

FIG. 4 shows a structure of a power turbine rotor which relates to one embodiment of the invention and the same numerals as in FIG. 1 show similar elements. The rotor shown in FIG. 4 differs from the rotor shown in FIG. 1 in that the keys 5A and 5G equipped in the disks 3*a* and 3*g* of the first stages are arranged at 180° with respect to each other and keys 5H, 5I, 5J, 5K and 5L equipped in disks 3*h*, 3*i*, 3*j*, 3*k* and 3*l* following one first stage are arranged at 180° with respect to neighbor keys and at the diametrically opposite portion in comparison with the embodiment in FIG. 1.

Keys 5A, 5B, 5C, 5D, 5E and 5F are respectively arranged in symmetry to a row of keys 5G, 5H, 5I, 5J, 5K and 5L with respect to the center of the shaft positioning between the disks 5A and 5G of the first stages. Each key is closely equipped in a key groove 21 (see FIG. 2) which is longitudinally formed on a circumferential surface of the shaft and a projected portion of the key is also closely equipped in a key groove which is formed on an inner circumferential surface of each disk. This arrangement of a key and groove per se is known in the field of turbines and therefore further details are dispensed with herein.

Figure 5:
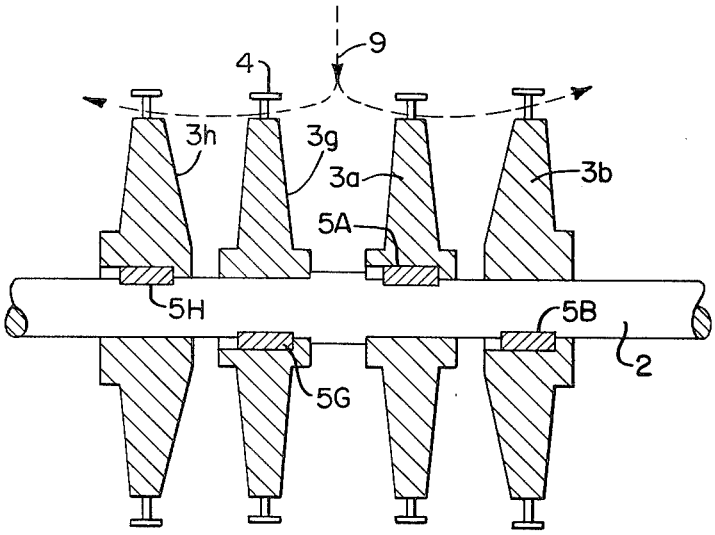
FIG. 5 is an enlarged view showing main parts of FIG. 4.

FIG. 5 shows an enlarged central portion of the rotor shown in FIG. 4.

Figure 6:
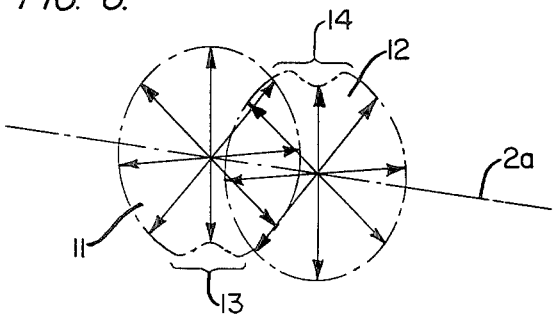
FIG. 6 is a view showing a temperature distribution on a shaft as shown in FIGS. 4 and 5.

FIG. 6 is a view showing the temperature distribution at a portion of the shaft on which the first stage disks 3*a* and 3*g* have been thermally shrunken. In FIG. 6 the numeral 2*a* shows the axis of the shaft, 11 shows the temperature distribution at a portion of the shaft on which the disk 3*g* is fixed and 12 shows the temperature distribution at a portion of the shaft on which the disk 3*a* is fixed.

The length of the arrows depicts the relative magnitude of the temperature. The numeral 13 and the numeral 14 indicate the presence of the keys 5A and 5G. Since the other keys are also arranged at 180° with respect to neighbor keys, the temperature distribution at a portion of the shaft on which the keys are equipped shows the similarity to that shown in FIG. 13, thus the low temperature extent shown by 13 and 14 appears at 180° with respect to each other at adjacent disks.

FIG. 7 is a view showing a state characterized in that one bending deflection offsets another bending deflection due to the difference of two temperature distributions. The temperature distribution around the disk 3*g* as shown in FIG. 6 gives rise to a thermal deflection of the shaft as shown in FIG. 7(A), while the temperature distribution around the disks 3*a* gives rise to another thermal deflection of the shaft, so that one thermal deflection acts so as to offset another thermal deflection. Thus the thermal deflection as shown in FIG. 7(C) finally almost appears.

According to this arrangement, an effect decreasing the thermal deflection can be obtained. In the first stages two temperature distributions are symmetrically located with respect to the longitudinal center of the shaft, between the disks 3*a* and 3*g* of the first stages. In a whole rotor the temperature distributions on both sets of stages are also symmetrical with respect to the longitudinal center of the shaft. This arrangement further makes the vibration of the shaft small.

As shown above, the key arrangement in which the keys are positioned so as to be arranged 180° with respect to neighbor keys reduces the amplitude of the vibration as shown in FIG. 8. In this Figure, Nr shows the rated speed, Nc shows a critical rotational speed, a dotted line B1 shows the amplitude of the vibration of the rotor shown in FIG. 1 and a solid line B2 shows the amplitude of the vibration obtained by the invention.

The temperature of a rotor in acceleration is usually low, so that the temperature difference between a side with a key equipped and another side without a key is small. Although both thermal distributions are not symmetrical, the temperature difference does not bend the shaft so seriously. Even though the key arrangement shown in FIG. 1 is employed, a rotor can be accelerated to the rated speed Nr in a condition of a comparatively small amplitude of the vibration.

However, with the passage of time during the operation of a turbine the temperature rise is high. This makes the temperature difference large. When a rotor is operated at the rated speed and at full load, this means an amount of steam is extremely large, an amplitude of the vibration is shifted from a small point a to a large point b. This means it is impossible to keep a constant operation.

Further, when a rotor in a vibration as shown at point b in FIG. 8 is decelerated, the amplitude of the vibration passes along the curve from a point n to a point c, because the thermal deflection of a shaft gives a large effect on the first vibration mode. The symbol c which shows an amplitude of the vibration at the critical rotational speed appears extremely large. The appearance of such a large amplitude of the vibration causes the most serious problem to a safe operation of the thermally shrink-fitted turbine rotor constructions.

In the thermally shrink-fitted turbine rotor provided by the invention, a rotor bending appears small, based on the thermal approximate symmetry on a rotor. At the acceleration and deceleration the amplitude of the vibration which is shown by curves A2 and B2 is extremely small. It is possible to continue a desirable operation of the turbine with a small amplitude of the vibration.

Figure 10:
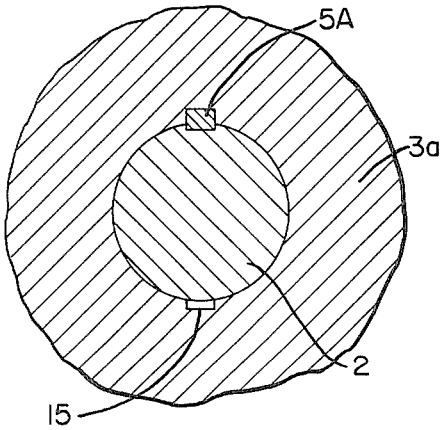
FIG. 10 is a sectional view along line X—X of FIG. 9.

FIGS. 9 and 10 show another embodiment of the invention with a rotor shaft 2, rotor disks 3*a* and 3*g* thermally shrink-fitted on the shaft 2 and keys 5A and 5G for fixing the disks 3*a* and 3*g* on the shaft 2.

This arrangement differs from the arrangement in FIGS. 4 and 5 in that grooves 15 and 15X are formed on contact surfaces between the disks 3*a* and 3*g* and the shaft 2. The forming of the grooves 15 and 15X causes the air in the grooves 15 and 15X to act as a thermal resistance against the heat conductivity from the disks 3*a* and 3*g* to the shaft 2, so that the temperature on a portion of the shaft on which are the grooves 15 and 15X becomes lower. Thus, the temperature distributions on the side where a key is equipped and the other side where no key is equipped exhibits a symmetry with respect to the axis of the shaft. This arrangement prevents a thermal bending which would otherwise occur based on the non-symmetry of the temperature distribution to the axis thereof.

Figure 11:
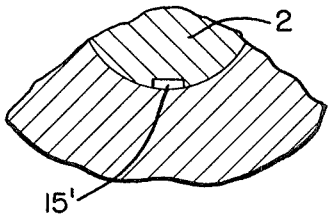
FIG. 11 is a partial sectional view showing another example with respect to a groove.

A similar effect can be obtained by the forming of the groove 15′ around the shaft 2 as shown in FIG. 11. Further, the groove 15 or 15′ may be formed on a plurality of circumferentially spaced portions, while one groove is shown in the above embodiment. Such a key arrangement permits that the keys are arranged in other positions rather than 180° with respect to a neighbor key.

Figure 12:
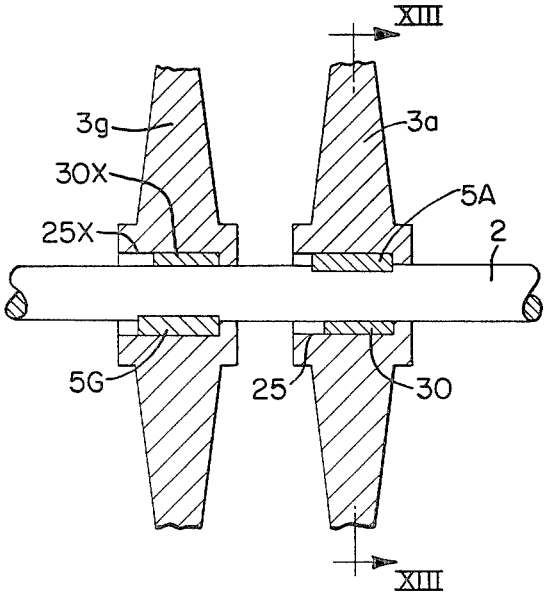
FIG. 12 is a vertical sectional view showing another embodiment of the invention.
Figure 13:
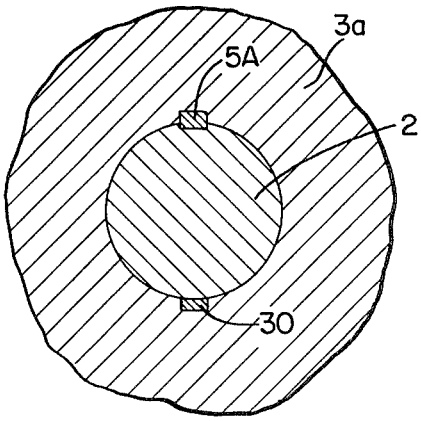
FIG. 13 is a sectional view along line XIII—XIII of FIG. 12.

Another embodiment is shown in FIGS. 12 and 13. Grooves 25 and 25X are formed on the diametrically opposite side on the inner circumferential surface of the disks 3*a* and 3*g* and dummy keys 30 and 30X are packed in the grooves 25 and 25X. The dummy keys are made of the identical material with the keys 5A and 5G. They have a function to resist the heat conductivity from the disks 3*a* and 3*g* to the shaft 2. Due to the function of the dummy keys 25 and 25X, the temperature distribution around the shaft 2 becomes symmetrical with respect to the axis of the shaft 2. A solid material with heat resistance also may be employed instead of the identical material with the keys 5A and 5G. With the embodiment of FIG. 13, one need only provide grooves in the disks for the dummy keys, so that the shaft structure need not be weakened by added grooves at the location of the dummy keys.

As should be apparent from the above description, according to the invention the thermal deflection of the rotor shaft is decreased, keeping the amplitude of the vibration small, so that steam turbines with high reliability can be provided.

What is claimed is:

1. A rotor for a double flow type of a steam turbine in which steam introduced into a turbine casing from a steam inlet is longitudinally divided and each divided steam portion flows in respective first stages disposed on the shaft adjacent to each other, comprising:

a shaft;

a first rotor disk attached to said shaft to form a first of said first stages of said steam turbine;

a second rotor disk attached to said shaft adjacent said first disk to form a second of said first stages of said turbine;

first key means disposed between said shaft and said first disk;

and thermal balancing means for counteracting thermal distortions of said shaft caused by said first key means, wherein the thermal balancing means includes a second key means disposed between said shaft and said second disk at a position so as to induce a thermal distortion in said shaft which counteracts said thermal distortions caused by said first key means under steam turbine operating temperature conditions, further comprising:

additional disks attached to said shaft at respective positions downstream of said first stages which form additional stages of said turbine;

additional key means arranged between said shaft and respective ones of said additional disks, wherein said additional key means are arranged within adjacent ones of said additional disks at positions offset by 180° about the circumference of the shaft for inducing thermal distortions in said shaft which counteract thermal distortions caused by said additional key means under steam turbine operating temperature conditions, wherein said thermal balancing means includes thermal resistance means for changing the thermal resistance between the shaft and the first and second disks, wherein the thermal resistance means includes a groove formed on the inner circumferential surface of the disk, and further comprising a dummy key packed in the groove.

* * * * *